US005531568A

United States Patent [19]

Broadhead

[11] Patent Number: 5,531,568

[45] Date of Patent: Jul. 2, 1996

[54] TURBINE BLADE

[75] Inventor: Peter Broadhead, Derby, England

[73] Assignee: Rolls-Royce plc, London, England

[21] Appl. No.: 463,521

[22] Filed: Jun. 5, 1995

[30] Foreign Application Priority Data

Jul. 2, 1994 [GB] United Kingdom ..... 9413377

[51] Int. Cl.[6] ..... F01D 5/18

[52] U.S. Cl. ..... 416/97 R; 416/191; 415/115

[58] Field of Search ..... 416/96 R, 96 A, 416/97 R, 97 A, 92, 189, 191, 192; 415/115, 116

[56] References Cited

U.S. PATENT DOCUMENTS 3,301,528 1/1967 Malley ..... 416/96 R
4,292,008 9/1981 Grosjean et al. .
4,616,976 10/1986 Lings et al. .
4,940,388 7/1990 Lilleker et al. .
5,122,033 6/1992 Paul .

FOREIGN PATENT DOCUMENTS 1516757 7/1978 United Kingdom .
2210415 6/1989 United Kingdom .
2223276 4/1990 United Kingdom .
9411616 5/1994 WIPO .

*Primary Examiner*—Thomas E. Denion
*Assistant Examiner*—Christopher Verdier
*Attorney, Agent, or Firm*—Cushman Darby & Cushman

[57] ABSTRACT

A turbine blade is provided with a shroud having at least one cooling air passage extending through it. A plurality of small apertures in the passage direct cooling air as a film across the outer surface of the shroud thereby cooling it. The shroud is therefore thinner and lighter than previous shrouds which are typically provided with a large number of internal cooling air passages.

6 Claims, 2 Drawing Sheets

TURBINE BLADE

FIELD OF THE INVENTION

This invention relates to a turbine blade and in particular to a turbine blade which is suitable for use in a gas turbine engine.

BACKGROUND OF THE INVENTION

Turbine blades in gas turbine engines are frequently provided with flange portions at their radially outer ends which cooperate with those of circumferentially adjacent blades to define a radially outer wall of the annular gas duct through which a major portion of the combustion products of the engine flow. These flange portions are normally referred to as forming the "shroud" of the blade, and where the term "shroud" is used in this specification it will have this meaning.

Gas turbine engine turbine blades are typically required to operate in an extremely high temperature environment, usually greater than the melting point of the alloy from which the turbine blade is manufactured. In order that the turbine blade is able to function effectively in this sort of environment, it is cooled by air tapped from the engine's compressor. The relatively cool air is directed into passages which extend from one end of each blade to the other. If the turbine blades in question are provided with shrouds, some of that cooling air may be directed into passages provided within the shrouds to cool them before being exhausted into the hot gas stream flowing over the turbine blades. Providing such cooling passages in the shrouds usually dictates the use of expensive machining techniques which inevitably result in high manufacturing costs. Additionally since there are limits to the size of the cooling passage which can be incorporated into a shroud, the shroud is frequently thicker than should otherwise be the case.

SUMMARY OF THE INVENTION

It is an object of the present invention to provide a turbine blade having a cooled shroud which is easier and cheaper to manufacture than existing cooled shroud turbine blades and also lighter.

According to the present invention, a turbine blade suitable for a gas turbine engine comprises an aerofoil cross-section portion having at least one cooling air passage extending lengthwise therethrough and a shroud located at one end thereof, said shroud having at least one cooling air passage therein which is in flow communication with said at least one lengthwise extending cooling air passage in said aerofoil cross-section portion and is apertured to exhaust cooling air therefrom as a film across that part of the exterior surface of said shroud which is remote from said aerofoil cross-section portion.

BRIEF DESCRIPTION OF THE DRAWINGS

The present invention will now be described, by way of example, with reference to the accompanying drawings in which.

DETAILED OF THE INVENTION

Figure 1:
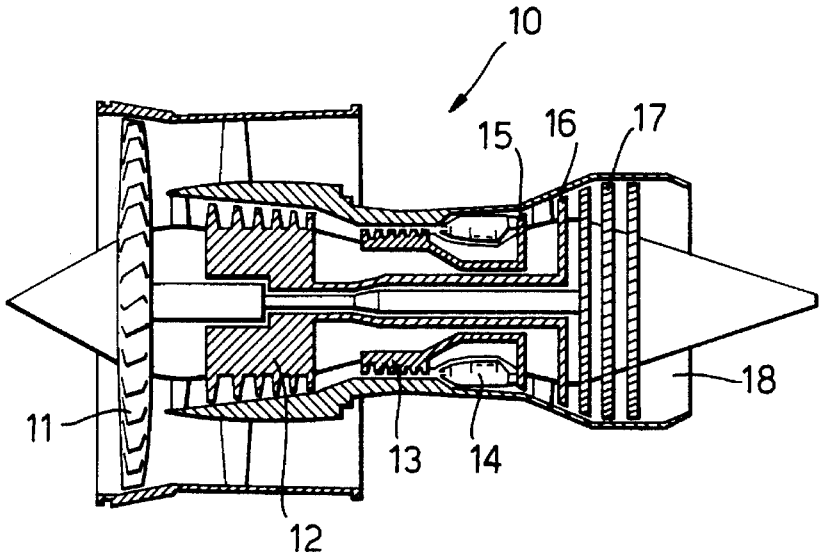
FIG. 1 is a schematic sectional side view of a ducted fan gas turbine engine which incorporates a plurality of turbine blades in accordance with the present invention.

With reference to FIG. 1, a ducted fan gas turbine engine generally indicated at 10 is of conventional configuration. It comprises, in axial flow series, a fan 11, intermediate pressure compressor 12, high pressure compressor 13, combustion equipment 14, high, intermediate and low pressure turbines 15, 16 and 17 respectively and an exhaust nozzle 18. Air is accelerated by the fan 11 to produce two flows of air, the larger of which is exhausted from the engine 10 to provide propulsive thrust. The smaller flow of air is directed into the intermediate pressure compressor 12 where it is compressed and then into the high pressure compressor 13 where further compression takes place. The compressed air is then mixed with fuel in the combustion equipment 14 and the mixture combusted. The resultant combustion products then expand through the high, intermediate and low pressure turbines 15, 16 and 17 respectively before being exhausted to atmosphere through the exhaust nozzle 18 to provide additional propulsive thrust.

Figure 2:
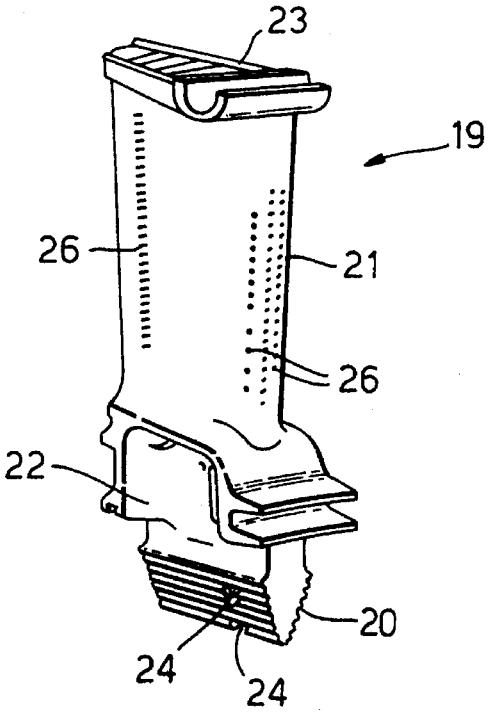
FIG. 2 is a view of a turbine blade in accordance with the present invention.

The high pressure turbine 15 includes a rotor disc (not shown) which carries an annular array of similar radially extending air cooled aerofoil blades, one of which 19 can be seen in FIG. 2. The aerofoil blade 19 is made up of a root 20, an aerofoil portion 21, a shank 22 which interconnects the root 20 and aerofoil portion 21, and a shroud 23 attached to the opposite end of the aerofoil portion 21 to the shank 22. The root 20 is of the well known "fir tree" cross-sectional configuration to facilitate its attachment to its rotor disc. Thus the rotor disc is provided with a plurality of similar fir-tree cross-section slots in its periphery; each one receiving a turbine blade root 20.

Figure 4:
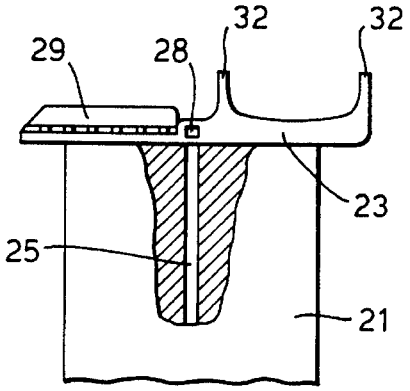
FIG. 4 is a partially sectioned side view of the radially outer extent of a turbine blade in accordance with the present invention.

The root 20 is provided with apertures 24 which are positioned so as to receive flows of cooling air supplied by conventional means to the rotor disc. The apertures 24 direct the cooling air into cooling air passages, part of one of which 25 can be seen in FIG. 4, which extend through the complete length of the turbine blade 19. Some of the air which passes through the passages 25 is exhausted through small film cooling holes 26 provided in the external surface of the aerofoil portion 21, thereby providing cooling of that surface.

Figure 3:
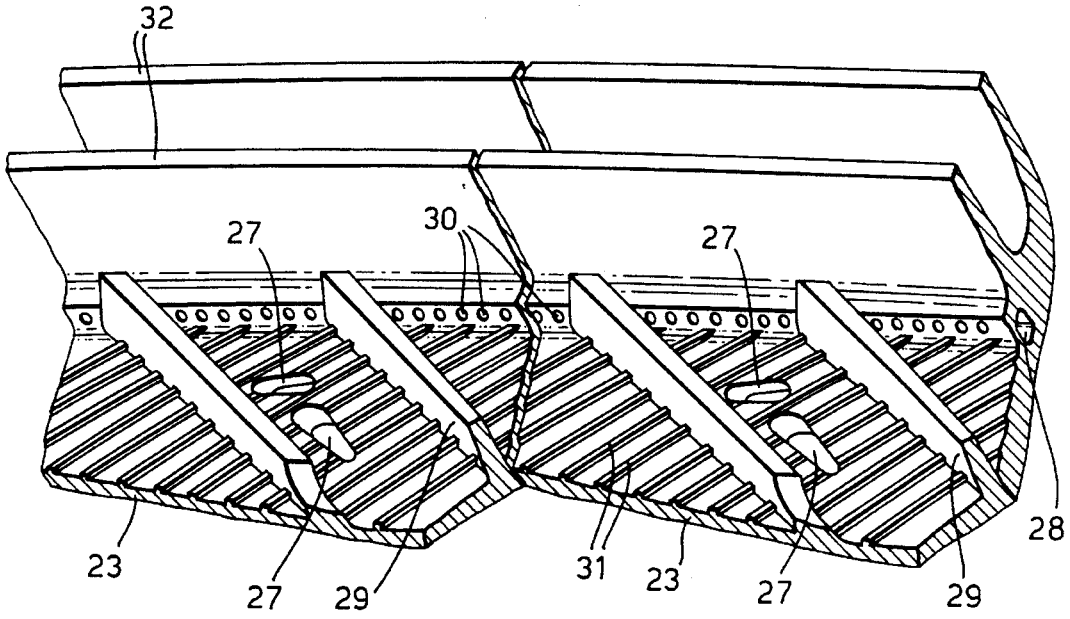
FIG. 3 is a view of the radially outer surfaces of the shrouds of the two adjacent turbine blades in accordance with the present invention.

The remainder of the air passes through the complete length of the aerofoil portion 21, thereby cooling it. When the remaining air finally reaches the shroud 23, some of that air is exhausted radially outwards through apertures 27 extending through the shroud 23 as can be seen in FIG. 3. However, the remainder is directed into a circumferentially extending passage 28 provided within the shroud 23. The passage 28 is open at each of its extents so that the passages 28 of adjacent the turbine blade shrouds 23 are in air flow communication with each other.

The radially outer surface of the shroud 23 is provided with several surface features. These include two radially outwardly and circumferentially extending sealing fins 32 which serve to minimize the leakage of combustion product gases between the radially outer extents of the turbine blades 21 and the annular stationary shroud (not shown) which conventionally surrounds them. Additionally the shroud 23 radially outer surface is provided with two radially extending fences 29 which are circumferentially spaced apart from each other and inclined with respect to the sealing fins 28 in order to redirect the cooling air exhausted from the apertures 27. The air which is exhausted from the apertures 27 has momentum. The fences 29 are so angled that the momentum of the air flow from the apertures 27 is directed so as to assist in the rotation of the turbine blades 21.

The passage 28 is provided with a large number of small circular cross-section apertures 30 along its total length. The radially outer surface of the shroud 23 is stepped adjacent the passage 28 so that air is exhausted from the apertures 30 so as to flow as a film across the shroud 23 radially outer surface. This film flow of cooling air from the apertures 30 serves to provide cooling of the shroud 23. In order to enhance this cooling effect a large number of small ribs or turbulators 31 are provided on the shroud outer surfaces. These ribs 31 produce turbulence in the cooling air flow across them, thereby enhancing the heat exchange relationship between the cooling air and the shroud 23. The ribs 31 additionally enhance, to a certain extent, the heat exchange relationship between the shroud 23 and the cooling air exhausted from the apertures 27.

As in the case of the cooling air exhausted from the apertures 27, the film of cooling air exhausted from the apertures 30 is directed in an appropriate direction by the fences 29. Indeed it may be desirable in certain cases to provide ribs on the fences 29 which are similar to the ribs 31 to enhance the heat exchange relationship between the cooling air and the fences 29, thereby enhancing shroud cooling still further.

It will be seen therefore that the cooling air film which is exhausted from the apertures 30 in the passage 28 serves to provide effective cooling of the shroud Consequently there is no requirement to provide a large number of internal cooling air passages within the shroud 23. The shroud 23 is therefore thin, and so light, and is comparatively simple and cheap to manufacture as part of the casing which constitutes the remainder of the turbine blade 19.

I claim:

1. A turbine blade for a gas turbine engine comprising an aerofoil cross-section portion having at least one cooling air passage extending lengthwise therethrough and a shroud located at one end thereof, said shroud having at least one cooling air passage therein which is in flow communication with said at least one lengthwise extending cooling air passage in said aerofoil cross-section portion and is apertured to exhaust cooling air therefrom as a film across that part of the exterior surface of said shroud which is remote from said aerofoil cross-section portion, said at least one cooling air passage being so disposed as to be generally circumferentially extending when said blade is mounted with a plurality of similar turbine blades in an annular array, said part of the exterior surface of said shroud across which said film of cooling air flows being configured so as to enhance the heat exchange relationship between said cooling air and said shroud.

2. A turbine blade as claimed in claim 1 wherein said part of the exterior surface of said shroud is so configured by the presence of a plurality of flow disturbing ribs thereon.

3. A turbine blade for a gas turbine engine comprising an aerofoil cross-section portion having at least one cooling air passage extending lengthwise therethrough and a shroud located at one end thereof, said shroud having at least one cooling air passage therein which is in flow communication with said at least one lengthwise extending cooling air passage in said aerofoil cross-section portion and is apertured to exhaust cooling air therefrom as a film across that part of the exterior surface of said shroud which is remote from said aerofoil cross-section portion, said at least one cooling air passage being so disposed as to be generally circumferentially extending when said blade is mounted with a plurality of similar turbine blades in an annular array, said shroud being provided with a step on that part of the exterior surface thereof which is remote from said aerofoil cross-section portion and which defines a surface generally normal to said exterior surface part, said step being positioned adjacent said at least one cooling air passage within said shroud so that the apertures in said at least one cooling air passage terminate at said step on said surface thereof which is generally normal to said exterior shroud surface part.

4. A turbine blade as claimed in claim 3 wherein said apertures are of similar circular cross-section.

5. A turbine blade for a gas turbine engine comprising an aerofoil cross-section portion having at least one cooling air passage extending lengthwise therethrough and a shroud located at one end thereof, said shroud having at least one cooling air passage therein which is in flow communication with said at least one lengthwise extending cooling air passage in said aerofoil cross-section portion and is aperture to exhaust cooling air therefrom as a film across that part of the exterior surface of said shroud which is remote from said aerofoil cross-section portion, said at least one cooling air passage being so disposed as to be generally circumferentially extending when said blade is mounted with a plurality of similar turbine blades in an annular array, fences being provided on said shroud exterior surface to direct said film of cooling air in such a direction as to operationally assist in the rotation of said turbine blades.

6. A turbine blade as claimed in claim 5 wherein said at least one cooling air passage in said shroud is open ended so as to be in flow communication with the similar cooling air passage of circumferentially adjacent turbine blades when mounted on a common disc.

* * * * *